US005385407A

United States Patent [19]

De Lucia

[11] Patent Number: 5,385,407

[45] Date of Patent: Jan. 31, 1995

[54] BEARING SECTION FOR A DOWNHOLE MOTOR

[75] Inventor: Frank V. De Lucia, Spring, Tex.

[73] Assignee: Dresser Industries, Inc., Dallas, Tex.

[21] Appl. No.: 235,545

[22] Filed: Apr. 29, 1994

[51] Int. Cl.[6] ..... E21B 4/02

[52] U.S. Cl. ..... 384/97; 175/107

[58] Field of Search ..... 384/97, 607, 619; 175/107, 232, 324, 337

[56] References Cited

U.S. PATENT DOCUMENTS

| | | | |
|---|---|---|---|
| 3,260,318 | 7/1966 | Neilson et al. . | |
| 3,318,397 | 5/1967 | Combes . | |
| 3,456,746 | 7/1969 | Garrison et al. | 175/320 |
| 3,489,231 | 1/1970 | Garrison et al. | 175/323 |
| 3,879,094 | 4/1975 | Tschirky et al. . | |
| 3,936,247 | 2/1976 | Tschirky et al. | 418/48 |
| 3,982,859 | 9/1976 | Tschirky et al. | 418/48 |
| 4,029,368 | 6/1977 | Tschirky et al. . | |
| 4,114,703 | 9/1978 | Matson, Jr. et al. | 175/107 |
| 4,260,031 | 4/1981 | Jackson, Jr. | 175/107 |
| 4,324,299 | 4/1982 | Nagel | 175/107 |
| 4,476,944 | 10/1984 | Beimbraben | 175/65 |
| 4,493,381 | 1/1985 | Kajikawa et al. | 175/107 |
| 4,501,454 | 2/1985 | Dennis et al. | 384/619 |
| 4,546,836 | 10/1985 | Dennis et al. | 175/107 |
| 4,560,014 | 12/1985 | Geczy | 175/107 |
| 4,577,704 | 3/1986 | Aumann | 175/107 |
| 4,819,745 | 4/1989 | Walter | 175/107 |
| 5,037,212 | 8/1991 | Justman et al. | 175/107 X |
| 5,048,981 | 9/1991 | Ide | 384/607 |
| 5,150,972 | 9/1992 | Wenzel | 384/97 |
| 5,248,204 | 9/1993 | Livingston et al. | 384/97 |

*Primary Examiner*—Thomas R. Hannon

*Attorney, Agent, or Firm*—Jones, Day, Reavis & Pogue

[57] ABSTRACT

A bearing section for a downhole motor that is coupled to a drill pipe string and that has a power section, a bearing section and a drill bit section. The improved bearing section includes a first drilling fluid lubricated bearing assembly being located between inner and outer cylindrical members, a second fluid sealed bearing assembly above said first drilling fluid lubricated bearing assembly between the inner and outer cylindrical members to prevent drilling fluid from the power section from directly reaching the first drilling fluid lubricated bearing assembly from within the inner and outer cylindrical members, and at least two orifices in the outer cylindrical member in the vicinity of the first bearing assembly for allowing drilling fluid exiting from said drill bit to enter therein and exit therefrom to lubricate the first bearing assembly.

20 Claims, 2 Drawing Sheets

BEARING SECTION FOR A DOWNHOLE MOTOR

BACKGROUND OF THE INVENTION

1. Field of the Invention

The present invention relates in general to the art of bearing assemblies and in particular to an improved bearing section for a downhole drilling motor that is carried near the end of a rotary drill string and actuated by the downflowing drilling fluid to drive a rotary drill bit for the drilling of oil and gas wells and the like.

The conventional U.S. system of oil well drilling involves the rotation of a string of drill pipe with a rotary drill bit located at the end of the drill string. Power from a motor or engine at the surface is transmitted to the bit by rotating the entire drill string. During drilling, a drilling fluid, generally called drilling mud, is pumped downward through the inside of the drill string and out through ports in the drill bit. The fluid then carries the material loosened by the drill bit back to the surface through the annular space between the drill pipe and bore hole. Many and varied circumstances make it desirable to drive the drill bit at speeds independent of the rotation of the drill string. A downhole motor is usually attached at or near the bottom of the drill string to accomplish such independent rotation of the drill bit. The motor may be electric or hydraulic. If hydraulic, it may be either a turbine or a positive displacement vane loader or it may be other types. All motors must have certain essential elements. First is a power section with a stator and a rotor which produce the torque and rotation between them. Next is a bearing section that includes thrust and radial bearing supports between the stationary and rotating members. Finally, there must be a flow path for the drilling fluid from the drill string to the drill bit, which path may be through the power section and at least partially through the bearing supports for lubrication. It will be realized that the drilling fluid and its contaminates are hostile to the function and life of the bearings and, therefore, control of the drilling fluid through the bearing section is significant to motor function, life, and overall drilling cost.

Such a system would require diversion of the drilling fluid flow through the bearing section with minimum erosion. Further, such control would substantially eliminate drilling fluid erosion at the intersection of the lower bearing section and its associated power or drive section. Further, the bearing section should be so constructed as to reduce thread fatigue breakage due to oscillating load conditions at the intersection of the lower bearing section and its top drive shaft. The bearing assemblies could be further protected if the drill pipe inner diameter drilling fluid flow could be diverted from direct flow through the bearing assembly and yet allow the drilling fluid to serve as the lubrication. Further, it would helpful to reduce the hydrostatic pressure applied to the bearing assemblies.

2. Description of Prior Art

To overcome such problems, in the prior art such as disclosed in U.S. Pat. No. 4,546,836, the bearing section included a series of elastomer flow restrictor elements each responding to increased fluid pressure by reducing the flow area therethrough thus controlling the fluid flow through the bearing within a narrow range of flow rates.

In U.S. Pat. No. 4,577,704, the bearing system includes a main thrust and radial bearing system having means for sealing the bearings in oil at equal or a slight pressure above that of the drilling mud inside the drill pipe. Thus the fluid seals and bearings were insulated from all possibility of contact with drilling cutting fluid and its associated debris created by the drilling operation.

In like manner, in U.S. Pat. No. 4,114,703, a lubricant chamber for the bearings is sealed with a piston that is pressurized by the drilling fluid flowing through the bearing section.

SUMMARY OF THE INVENTION

The present invention is directed to increasing the service life of the bearings at the lower end of the bearing section or assembly. There are usually two spaced bearing assemblies in the bearing section that are designed to compensate both for side or radial loading and thrust loading. In the present invention, a high pressure fluid flow restrictor is placed between the inner and outer hollow cylindrical pipes or members as a seal to prevent the drilling fluid from entering the space between the inner and outer cylindrical members and to force the drilling fluid to flow through the hollow center of the inner cylindrical member to the drill bit section. This restrictor includes bearings to form a first bearing assembly. A drill fluid lubricated bearing assembly forms a second bearing assembly spaced from the first bearing assembly and is located between the inner and outer cylindrical members. Orifices in the outer cylindrical member in the vicinity of the second bearing assembly allow drilling fluid exiting from the drill bit and returning uphole to enter therein and exit therefrom to lubricate the second bearing assembly. Because the fluid flow restrictor creates a reduced pressurized cross-sectional area with respect to the second bearing assembly, a reduced drilling fluid thrust pressure per square inch is developed on the second bearing assembly for a given drilling fluid pressure thereby reducing wear thereof.

The high pressure fluid flow restrictor forming the first bearing assembly comprises first and second spaced annular bearings in a fluid-tight arrangement between the inner and outer concentric hollow cylinder members with a fluid sealed in the spaced between the first and second annular bearings. The high pressure fluid flow restrictor can move longitudinally with respect to the inner and outer hollow cylinder members when under pressure to act as a hydrostatic pressure compensation system by balancing opposing pressures and substantially preventing a pressure differential across the high pressure fluid flow restrictor. Thus again wear and tear on the bearings is reduced.

Further, the bearing section includes a novel coupling adapter for coupling the bearing section to the power section. It has an elongated annular wall having a first portion with a first thickness forming a member with a hollow cylindrical core and having one end sealed to form a closed upper end and a second portion forming an inverted cup-shaped lower end. The second portion of the annular wall has a second thickness less than the first thickness of the first portion. External threads are formed around a portion of the closed upper end for attaching to the power section. Threads are formed on at least a portion of the interior of the cup-shaped lower end for attachment to the bearing section. If the bearing section has tapered threads, the threads on the portion of the interior of the cup-shaped lower end may also be tapered correspondingly. These threads allow the coupling adapter to be attached to the bearing section.

A hollow core in the coupling adapter is in axial alignment with the hollow center of the inner cylindrical member in the bearing section. Substantially opposing slots are formed in the first thickness of the elongated annular wall in fluid transfer relationship with the hollow core for allowing drilling fluid from the power section to enter the hollow core to travel to the drill bit section. Each of the opposing slots has a first wall extending into the hollow core at substantially a tangent to the hollow core. Each of the opposing slots also has a second wall extending into the hollow core at an angle with respect to the corresponding first wall so as to impart a rotation to drill bit fluid entering into the opposed slots to transform any turbulent flow of drilling fluid into laminar flow as it moves through the hollow core of the inner cylindrical member of the bearing section to the drill bit section. This again helps to eliminate erosive wear of the bearing assembly components.

The present invention also allows existing bearing sections of a downhole motor to be retrofitted to provide the advantages set forth herein. In the novel method, the upper drill fluid lubricated bearing is removed from between the inner and outer hollow cylindrical members and a sealed bearing is inserted between the inner and outer hollow cylindrical members in place of the removed bearing assembly. The sealed bearing prevents drilling fluid from directly reaching the lower spaced bearing assembly from within the inner and outer hollow cylindrical members. At least two spaced orifices are drilled into the outer hollow cylindrical member in the vicinity of the lower spaced bearing assembly for allowing drilling fluid exiting from the drill bit to enter therein and exit therefrom to lubricate the lower spaced bearing assembly.

Thus it is an object to the present invention to provide a retrofit capability for standard industry utilized drilling fluid lubricated bearing assembly.

It is also an object to the present invention to divert a drilling fluid flow through the inner diameter of the inner cylindrical member or pipe with minimum erosion.

It is still another object of the present invention to substantially eliminate drilling fluid erosion at the intersection of the coupling adapter and the top of the rotating inner cylindrical member in the bearing section.

It is yet another object of the present invention to reduce thread fatigue breakage due to oscillating loads at the junction of the coupling adapter and the top of the rotating inner concentric cylindrical member of the bearing section.

It is still another object of the present invention to utilize a sealed high pressure flow restrictor in the bearing section to eliminate drilling fluid flow directly through the lower drilling fluid lubricated bearing assembly and to cause the lower bearing assembly to be lubricated with drilling fluid only after it exits the drill bit.

It is also an object to the present invention to reduce the hydraulic thrust cross-sectional pressurized area on the lower drilling fluid lubricated bearing assembly by providing the sealed high pressure flow restrictor.

It is yet another object of the present invention to provide hydrostatic pressure compensation by enabling the sealed high pressure flow restrictor to move longitudinally between the inner and outer concentric pipe members of the bearing section to adjust for any pressure differential that may exist.

Thus the present invention relates an improved bearing section for a downhole motor that couples to a drill pipe, the downhole motor including a power section, a bearing section and a drill section and wherein the bearing section has an upper end and a lower end, an outer cylindrical member, a rotatable concentric inner cylindrical member having a hollow center and being in radial spaced relationship with the outer cylindrical member for receiving drilling fluid from the drill pipe through the hollow center thereof, and bearing means for supporting the inner and outer concentric cylindrical members for relative rotation by the power section and for absorbing both radial and thrust loads therebetween.

The improved bearing section comprises a high pressure fluid flow restrictor between the inner and outer hollow cylindrical members that is sealed from the drilling fluid to force the drilling fluid to flow through the hollow center of the inner cylindrical member to the drill bit section. The fluid flow restrictor forms a first bearing assembly. A drill fluid lubricated bearing assembly forming a second bearing assembly is spaced from the first bearing assembly and is located between the inner and outer cylindrical members. Orifices in the outer cylindrical member in the vicinity of the second bearing assembly allow drilling fluid exiting from the drill bit to enter therein and exit therefrom to lubricate the second bearing assembly.

The invention also relates to a coupling adapter for coupling the bearing section to the power section of a downhole motor, the coupling adapter comprising an elongated annular wall having a first portion with a first thickness forming a member with a hollow cylindrical core and having one end sealed to form a closed upper end and a second portion forming an inverted cup-shaped lower end. The second portion of the annular wall has a second thickness less than the first thickness of the first portion. External threads are formed around a portion of the closed upper end for attaching the coupling adapter to the power section of the downhole motor. Threads are also formed on at least a portion of the interior of the cup-shaped lower end for attaching to the inner cylindrical member of the bearing section. The threads on the cup-shaped portion may be tapered if desired to match a corresponding tapered thread on the top of the inner cylindrical member of the bearing section. The hollow core of the coupling adapter is in axial alignment with the hollow center of the inner cylindrical member. Substantially opposing slots in the first thickness of the elongated annular wall of the coupling adapter are in fluid transfer relationship with the hollow core of the coupling adapter for allowing drilling fluid from the power section to enter the hollow core for travel through the bearing section to the drill bit section. Each of the opposing slots has a first wall extending into the hollow core at substantially a tangent to the hollow core and a second wall extending into the hollow core at an angle with respect to the first wall so as to impart a rotation to the drill bit fluid entering the opposed slots to transform any turbulent flow of drilling fluid into laminar flow as it moves through the hollow core of the inner cylindrical member to the drill bit section. The angle at which the second wall extends into the hollow may be greater than 45 degrees with respect to the first wall.

In its broadest sense, the invention relates to an improved bearing section for a downhole motor which includes a drill fluid lubricated bearing assembly being located between inner and outer cylindrical members to provide bearing support, a fluid sealed bearing assembly above the drill fluid lubricated bearing assembly between the inner and outer cylindrical members to provide bearing support and to prevent drilling fluid from the power section from directly reaching the drill fluid lubricating assembly from within the inner and outer cylindrical members. At least two orifices are formed in the outer cylindrical member in the vicinity of the second bearing assembly for allowing drilling fluid exiting from the drill bit to enter therein and exit therefrom to lubricate said second bearing assembly.

Finally, the invention also relates to a method of retrofitting the bearing section of an existing downhole motor wherein the bearing section has an upper end and a lower end and upper and lower spaced drill fluid lubricating bearing assemblies. The retrofit method comprises the steps of removing the upper drill fluid lubricated bearing from between the inner and outer hollow cylindrical members, inserting a sealed bearing between the inner and outer hollow cylindrical members to replace the upper drill fluid lubricated bearing assembly that was removed for preventing drilling fluid from directly reaching the lower spaced bearing assembly from within the inner and outer hollow cylindrical members, and drilling at least two spaced orifices in the outer hollow cylindrical member in the vicinity of the lower spaced bearing assembly for allowing drilling fluid exiting from the drill bit to enter therein and exit therefrom to lubricate the lower spaced bearing assembly.

BRIEF DESCRIPTION OF THE DRAWINGS

These and other objects of the present invention will be more fully disclosed when taken in conjunction with the following DETAILED DESCRIPTION OF THE DRAWINGS in which like numerals represent like elements and in which.

DETAILED DESCRIPTION OF THE DRAWINGS

Figure 1:
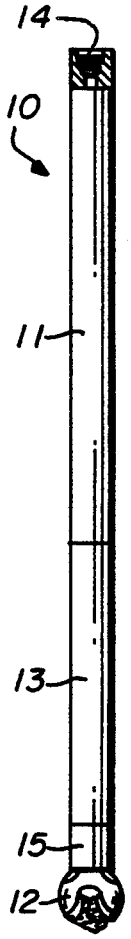
FIG. 1 is a longitudinal view illustrating a downhole drilling motor.

Referring now to the drawings and to FIG. 1 in particular, a downhole motor is illustrated and generally designated by the reference numeral 10. The downhole motor 10 is provided with a bearing section 13 and a power section 11. The power section 11 may be any suitable type of fluid power device. For example, the power section 11 may be a hydraulic turbine or a Moineau pump as is well known in the art. The power section 11 is connected to the lower end of a drill string of tubular members (not shown) extending to the surface. The threaded connection 14 allows the power section 11 to be connected to the drill string. The drilling fluid is circulated down through the drill string and through the power section 11 and bearing section 13. The lower end of the bearing section 13 is connected to a rotating bit subunit 15 which carries the drill bit 12.

Figure 2A:
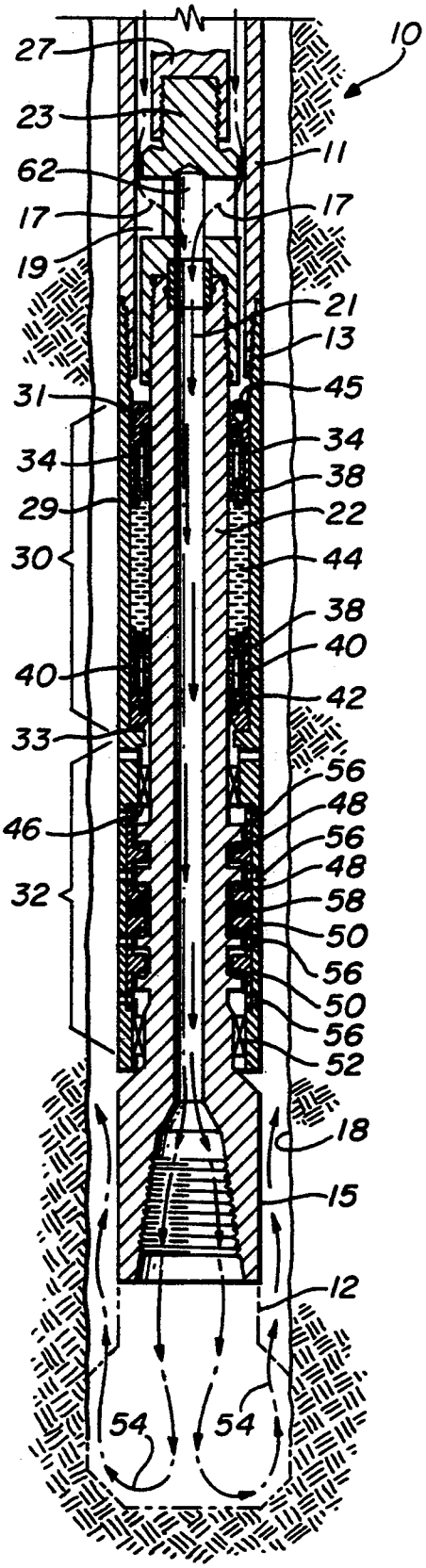
FIGS. 2A and 2B are a cross-sectional illustration of the bearing section of the present invention that could be used with a downhole drilling motor.
Figure 2B:
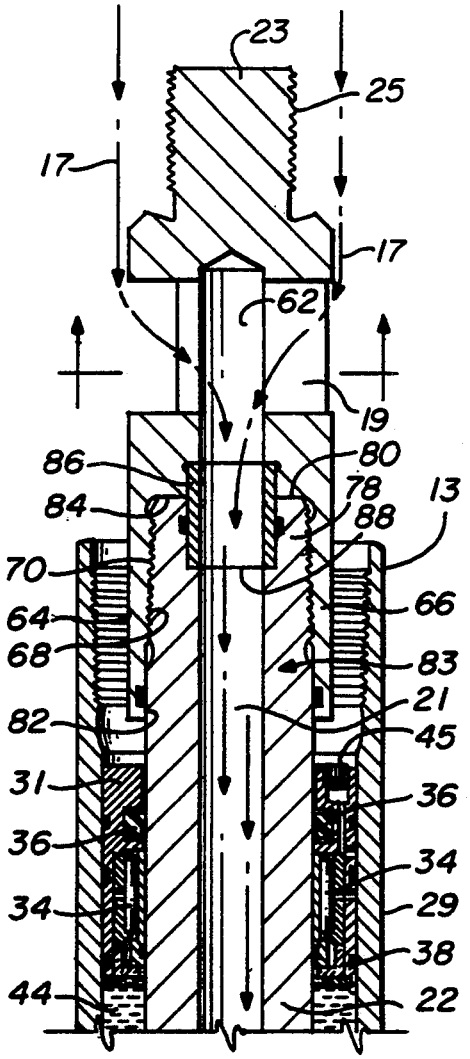

FIG. 2 is a cross-sectional view of the novel bearing section 13 according to the present invention. It is shown coupled to the power section 11 (in phantom lines) and to the rotating bit subsection 15 and drill bit 12, both of which are also shown in outline form only. As can be seen in FIG. 2, the drilling fluid flow 17 leaves the power section 11 and enters through orifices 19 into the hollow center 21 of the rotatable concentric inner cylindrical member 22. Rotatable concentric inner cylindrical member 22 is coupled at the upper portion thereof by a sealed upper end 23 that has external threads 25 thereon for mating with the rotatable portion 27 of the power section 11. The rotatable concentric inner cylindrical member 22 is in radial spaced relationship with the outer cylindrical member 29. Spaced bearing assemblies 30 and 32 support the inner and outer cylindrical members 22 and 29 for relative rotation by the power section 11 and for absorbing both radial and thrust loads therebetween.

The upper bearing section 30 forms a high pressure fluid flow restrictor between the inner and outer hollow cylindrical members 22 and 29 and forms a seal from the drilling fluid 17 to force the drilling fluid to flow through the hollow center 21 of the inner cylindrical member 22 to said drill bit section 15. The high pressure fluid flow restrictor or first bearing assembly 30 includes spaced apart needle roller radial bearings 34 and 40 that are mounted in respective bearing races 31 and 33. Bearing races 31 and 33 are annular in shape and surround and fill the space between the outer cylindrical member or pipe 29 and the rotatable concentric inner cylindrical member or pipe 22. Low pressure rotary seal 36 and static seals such as O-ring 38 form liquid-tight seals to prevent said drilling fluid from flowing between the rotatable concentric cylindrical member 22 and the outer cylindrical member of pipe 29. A liquid 44 such as oil is injected into the space between the spaced apart needle bearings 34 and 40 through a closable orifice 45. The two needle bearing units 34 and 40 and the liquid 44 in between them are movable longitudinally in the space between the inner and outer cylindrical members 22 and 29 and thus provide a hydrostatic pressure compensation system. That is, the upper bearing assembly 30 will move longitudinally to equalize the pressure on either side thereof.

To support the rotating bit 12 and the drive shaft or rotatable concentric inner cylindrical member 22, the bearing section 13 is equipped with thrust bearings such as ball-type bearings 48 and 50. These thrust bearings 48 and 50 constrain the rotating drive shaft 22 against downward hydraulic thrust and upward forces that may be generated by placing weight on the bit 12. The radial bearings 46 and 52 and their corresponding races are cooled and lubricated by a small amount of drilling fluid as it exits from the drilling bit 12. When drilling fluid flows through a positive displacement annular downhole motor, all of the flow is through the hollow center of the drive shaft section 22 as explained previously. As can be seen in FIG. 2 by the phantom fluid flow path indication 54, the fluid passes through the drill bit 12, and goes back uphole between the outer cylindrical member 29 and the hole side wall 18. As it does so, it passes the drill fluid lubricated bearing assembly 32. By forming orifices 56 in the outer cylindrical member 29 in the vicinity of the lower bearing assembly 32, a small percentage of the fluid goes through the vent holes 56 spaced annularly around the outer pipe or cylinder 29. This path is known as the leak flow path. Within the leak flow path are the radial bearings 46 and 52 and the thrust bearings 48 and 50. The thrust bearings 48 are the "off-bottom" thrust bearings while the thrust bearings 50 are the "on-bottom" thrust bearings. The radial bearings 46 and 52 keep the rotatable concentric inner cylindrical member or drive shaft 22 concentric with the outer cylindrical member 29 and react to bit forces and side or radial loads. The thrust bearings 48 and 50 primarily take the hydraulic down thrust from the down hole motor and the weight-on-bit load. Fluid flow is necessary through the leak path in order to lubricate and cool these bearings. The down thrust bearings 48 and the on-bottom thrust bearings 50 are interconnected to allow the bearings to share these opposing axial loads. Only a differential load is carried by the bearings. The ideal operating condition exists when the hydraulic down thrust load matches the weight on the bit and the two forces cancel each other out. Since the thrust bearings 48 and 50 have no external loads applied to them, a balanced condition will result in the thrust bearings having the longest possible life. A Belleville spring shock absorber 58 is placed between the two thrust bearings 48 and 50 to absorb axial shock as the pressure transfers from one set of bearings to the other.

Since the drilling fluid flow path through the orifices 56 and to the thrust bearings and the radial bearings is a leak path, the pressure applied to the bearings is less than that which would be applied by a direct application of the drilling fluid to the bearings as it comes down the drilling pipe, there is less erosion of the thrust and radial bearings-thus prolonging their lives.

Part of the erosion and wear that occurs in a bearing section is in the area where the drilling fluid enters the hollow center of the drive shaft or rotatable concentric inner cylindrical member 22. In order to alleviate this problem, a coupling adapter is provided to attach the inner hollow cylindrical member 22 to the drive shaft of the motor section 11. The coupling adapter 60 includes a hollow cylindrical interior 62 and a sealed upper end 23 which, as stated earlier, has external threads 25 thereon so that it can be threadedly attached to the drive shaft 27 of the motor section 11. It also has an inverted cup-shaped lower end 64 having an annular wall 66 with tapered interior threads 68 for attaching to the threaded section 70 on the upper end of the inner hollow cylindrical member or drive shaft 22. Substantially opposing slots 19 in the coupling adapter 60 allow turbulent drilling fluid flowing along a path as indicated at 17 to enter the hollow interior 62 of the coupling adapter and from there to the hollow center 21 of the inner cylindrical member 22 for travel to the drill bit section 15. Each of the opposing slots 19 has a first wall 72 which can be best seen in FIG. 3 that extends into the hollow interior 62 at substantially a tangent to the hollow interior as shown. In addition, each of the opposing slots 19 has a second wall 74 extending into the hollow interior 62 at an angle greater than 45 degrees with respect to the first wall so as to impart a rotation to the drill bit fluid flowing in path 17 as it enters the opposed slots 19 to transform any turbulent flow of the drilling fluid to laminar flow as it moves through the hollow center 21 of the inner cylindrical member 22 to the drill bit section 15. An erosion resistant coating surface 76 may be formed on each wall 72 and 74 of each of the opposing slots 19 to reduce the rate of erosion of the opposing slot walls. The erosion resistant coating may be, for instance, tungsten carbide.

The inner hollow cylindrical member 22 has an upper portion 78 that has a flat upper top 80. It also has a threaded annular external portion 70 that is detachably engagable with the interior threads 68 of the inverted cup-shaped lower end 64 of the coupling adapter 60. A substantially cylindrical peripheral portion 82 of the upper portion of the inner hollow cylindrical member 22 extends below the threaded annular external portion 70. A flat surface 84 forms a base on the inside of the inverted cup-shaped lower end 66 of the coupling adapter 60 for engaging a corresponding flat upper top 80 of the inner hollow cylindrical member 22 at a junction to form a first substantially fluid-tight seal at the junction. An annular skirt 82 forms part of and extends downwardly from the annular wall 66 of the inverted cup to a point below the threaded external annular portion 70 of the inner hollow cylindrical member 22 to engage the cylindrical peripheral portion 82 of the inner hollow cylindrical member 22 to form a second substantially fluid-tight seal as well as a support for oscillating loads. An annular recess 86 is formed in the hollow center 21 of the inner hollow cylindrical member 22 and extends into the hollow interior 62 of the coupling adapter 60. An abrasion resistant annular hollow collar 88 is matingly inserted in the recess 86 in the inner hollow cylindrical member 22 and in the hollow interior 62 of the coupling adapter 60 and has an inside diameter aligned with and substantially equal to that of the hollow center 21 of the inner hollow cylindrical member 22 and the hollow interior 62 of the coupling adapter 60 and is positioned over the junction 80, 84 of the flat upper top 80 of the inner hollow cylindrical member 22 and the flat surface 84 forming the base of the inside of the inverted cup-shaped lower end 64 of the coupling adapter 60.

As indicated earlier, the first and second spaced annular needle bearings 34 and 40 are in fluid-tight arrangement between the inner and outer concentric hollow cylinder members 22 and 29 with a fluid 44 sealed in the space between the first and second annular bearings 34 and 40.

Also as stated earlier, each of the first and second annular bearings 34 and 40 of the fluid flow restrictor 30 includes a rotary seal 36 or 42 that is used to assist in preventing the drilling fluid flow from the drill pipe from passing between the inner and outer hollow concentric cylindrical members 22 and 29. A radial bearing 34 in a bearing race 31 assists in controlling oscillating loads. A plurality of static O-ring seals 38 utilize a high interference fit to prevent rotation of the bearing race 31 and to create a sealed surface to assist in preventing the drilling fluid from entering the space between the first and second annular bearings 34 and 40 where the oil or other fluid 44 is located. The rotary seal 36 for the first annular bearing 34 is a low pressure seal and the rotary seal 42 for the second bearing assembly 40 is a high pressure seal. Also as stated earlier, the second bearing assembly 32, the drilling fluid lubrication bearing assembly, includes both thrust bearings 48 and 50 and radial bearings 46 and 52.

Without the sealed upper bearing assembly 30, the fluid flow would not be restricted to the hollow center 21 of the inner cylindrical member 22 but would pass down the area between the inner concentric cylinder 22 and the outer cylinder 29 thus having a cross-sectional area substantially equal to the inside diameter of the outer pipe or cylinder 29 over which area the pressure of the drill fluid would be spread to place a given force on the drilling fluid lubrication bearing assembly 32. However, because of the fluid flow restrictor or first bearing assembly 30, the fluid is forced down the center 21 of the inner cylindrical member 22 and thus the pressurized cross-sectional area is limited to the outer diameter of the inner cylindrical member 22. Since the total pressure is the pressure per square inch times the area in square units such as inches, and since the area (square inches) is reduced by the present invention as indicated, a lower total pressure is applied to the bearing assembly 32. Thus the fluid flow restrictor creates a reduced pressurized cross-sectional area with respect to the second bearing assembly 32 to cause a reduced drilling fluid thrust pressure per square inch on the second bearing assembly 32 for a given drilling fluid pressure.

Thus, in its broadest sense, the present invention provides an improved bearing section 13 that includes a first drilling fluid lubricated bearing assembly 32 being located between inner and outer cylindrical members 22 and 29, a second fluid sealed bearing assembly 30 above the first drill fluid lubricated bearing assembly 32 between the inner and outer cylindrical members 22 and 29 to prevent drilling fluid from the power section 11 from directly reaching the first drill fluid lubricated bearing assembly 32 from within the inner and outer cylindrical members 22 and 29 and at least two orifices 56 in the outer cylindrical member 29 in the vicinity of the first bearing assembly 32 to allow drilling fluid exiting from the drill bit 12 to enter therein and exit therefrom to lubricate the first bearing assembly 32.

Figure 3:
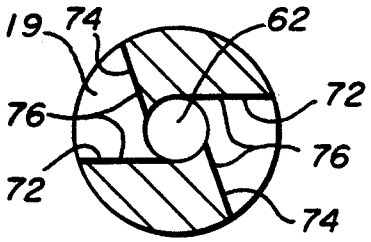
FIG. 3 is a cross-sectional view as taken along lines 3—3 of FIG. 2.

In operation, the power section 11 rotates shaft 27 that is threadedly attached at 25 to the upper portion 23 of the coupling adapter 60 that is attached threadedly at 68 and 70 to the drive shaft or inner concentric member 22 to rotate the same. The drilling fluid passes downwardly from the power section 11 in path 17 through slots 19 into the hollow interior 62 of the coupling adapter 60 and the hollow center 21 of the rotating inner concentric member 22. Because the slots 19 are shaped as indicated in FIG. 3, a spin or rotation is applied to the fluid causing any turbulent flow to be changed to a laminar flow as it moves down through the center 21 of the inner concentric member 22 thus reducing erosion effects of the drilling fluid. An abrasive resistant collar 88 is placed in a recess 86 that covers the junction between the top flat surface 80 of the inner concentric member 22 and the base 84 of the cup-shaped portion 64 of the coupling adapter 60 to prevent erosion at that junction. The fluid flow restrictor 30 forms a first bearing assembly that prevents the drilling fluid from continuing to flow downwardly between the outer cylindrical member or pipe 29 and the rotating concentric inner cylindrical member 22. In addition, it has radial bearings to absorb radial pressures and to maintain the rotating inner cylindrical member 22 concentric with the outer cylindrical member 29. In addition, with the fluid 44 between the upper bearing 34 and the lower bearing 40, the entire upper bearing assembly 30 can move longitudinally between the inner and outer concentric cylinders 22 and 29 to provide hydrostatic pressure condensation.

Since the drilling fluid cannot directly reach the drilling fluid lubricated bearing assembly 32 from within the inner and outer cylinder members 22 and 29, it must exit from the bit and start to back up uphole between the outer cylinder member 29 and the side wall of the bore hole 18. It then is allowed to enter orifices 56 in the outer cylindrical member 29 in the vicinity of the bearing assembly 32 thus enabling the drilling fluid exiting from the drill bit 12 to enter therein and exit therefrom to lubricate the bearing assembly 32. Since the orifices 56 form a "leak path", the bearings are lubricated under less pressure than that which would be applied directly to them as in the prior art. In addition, the fluid in the orifices 56 is also coupled to the base of the fluid sealed bearing assembly 30 to provide pressure on the bottom thereof and provide the hydrostatic pressure compensation.

Figure 4:
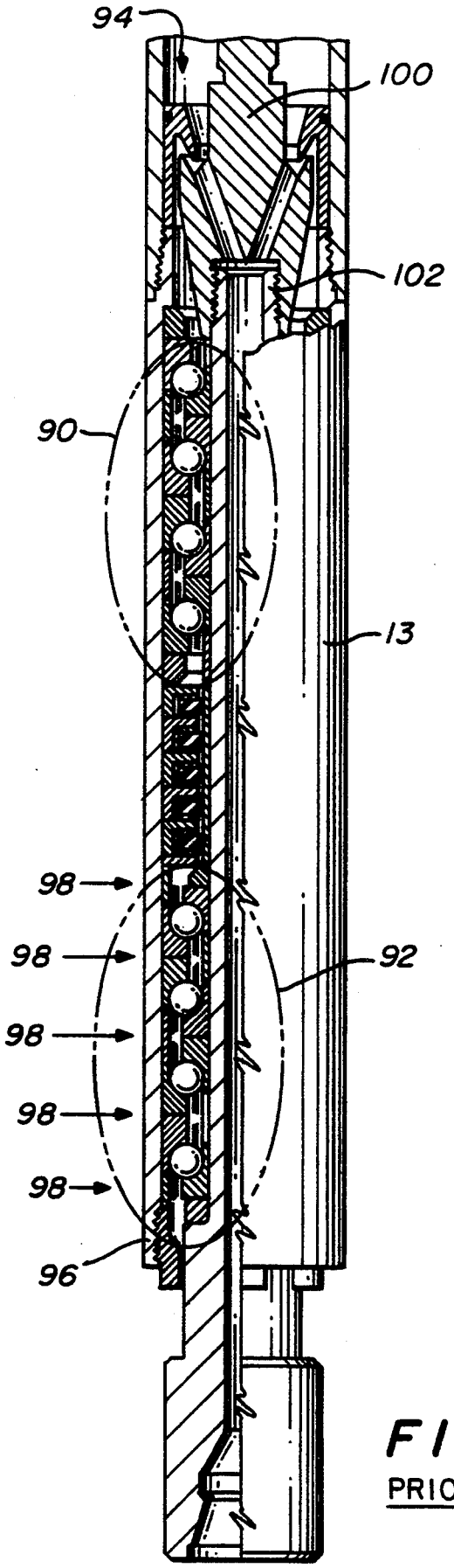
FIG. 4 PRIOR ART
FIG. 4 is a partial cross-sectional view of a prior art bearing section having upper and lower bearing assemblies that are lubricated with drilling fluid and that can be retrofitted to include the present invention.
Figure 5:
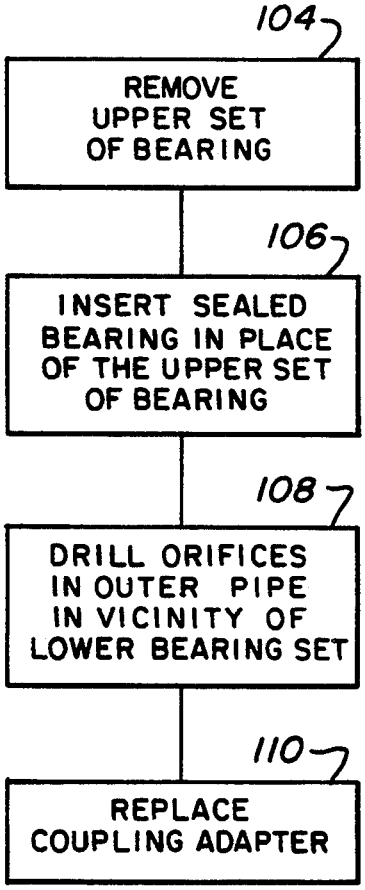
FIG. 5 is a flow chart illustrating the steps required to modify the bearing assembly of FIG. 4 to form a retrofit assembly using the present invention.

FIG. 4 is a partial cross-sectional longitudinal view of a prior art bearing section 13 that can be retrofitted with the bearing section of the present invention. It can be seen in FIG. 4 that the bearing assembly 13 has an upper set of drilling fluid lubricated bearings 90 and a lower set of drilling fluid lubricated bearings 92. Part of the drilling fluid following path 94 is diverted through the area assemblies 90 and 92 to lubricate them as is well known in the prior art. To convert or retrofit the bearing section 13 in FIG. 4, the unit is disassembled in the normal fashion and the upper set of drilling fluid lubricated bearings 90 are removed and replaced with the fluid restrictor or fluid sealed bearing assembly 30 shown in FIG. 2. In addition, orifices are drilled in the outer cylindrical member 96 in the vicinity of the lower bearing assembly 92 where indicated by the arrows 98. The coupling adapter 100 is replaced with the coupling adapter 60 shown in FIG. 2 and the junction 102 will have to have a recess machined therein to receive the abrasion resistant collar 88 shown in FIG. 2. Thus as shown in the steps in FIG. 5, the upper set of bearings is removed at step 104, the sealed bearings are inserted in place thereof at step 106, orifices are drilled in the outer cylinder in the vicinity of the lower bearings to allow the drilling fluid to enter and exit at step 108 and, at step 110, the coupling adapter is replaced. Therefore, the present invention provides a method of retrofitting the bearing sections of an existing downhole motor.

Thus, there has been disclosed a novel bearing section for a downhole motor that couples to a drill pipe string and that has a power section, a bearing section, and a drill bit section. Drilling fluid moving down the drill string from an uphole source drives the power section and rotates the drilling bit. The drilling fluid exits from the drilling bit to return uphole between the bore hole and the outer pipe casing. The bearing section of the downhole motor has an upper end and a lower end, an outer hollow cylindrical member and a rotatable concentric inner hollow cylindrical member in radial spaced relationship with the outer hollow cylindrical member. Bearing means support the inner and outer cylindrical members for relative rotation by the power section and for transmission for both thrust loads and radial loads therebetween. The novel bearing section includes a first drilling fluid lubricated bearing assembly being located between the inner and outer cylindrical members. A second fluid sealed bearing assembly is located above the first drilling fluid lubricated bearing assembly between the inner and outer cylindrical portions to prevent drilling fluid from the power section from directly reaching the first drilling fluid lubricated bearing assembly from within either the inner or the outer cylindrical members. At least two orifices are formed in the outer cylindrical member in the vicinity of the first bearing assembly for allowing drilling fluid exiting from the drill bit to enter therein and exit therefrom to lubricate the first bearing assembly.

The foregoing specification describes only the embodiments of the invention shown. Other embodiments may be articulated as well. The terms and expressions used, therefore, serve only to describe the invention by example and not to limit the invention. It is expected that others will perceive differences, which, while different from the foregoing do not depart from the scope of the invention herein described and claimed. In particular, any of the specific structural elements described may be replaced by any other known elements having equivalent functions.

I claim:

1. In a downhole motor for coupling to a drill pipe and having a power section, a bearing section and a drill bit section, the bearing section having an upper end and a lower end, an outer cylindrical member, a rotatable concentric inner cylindrical member having a hollow center for receiving drilling fluid from said drill pipe and being in radial spaced relationship with the outer cylindrical member, and bearing means for supporting said inner and outer cylindrical members for relative rotation by said power section and for absorbing both radial and thrust loads therebetween, an improved bearing section comprising:

a high pressure fluid flow restrictor between said inner and outer hollow cylindrical members and sealed from said drilling fluid to force said drilling fluid to flow through the hollow center of said inner cylindrical member to said drill bit section, said restrictor forming a first bearing assembly;

a drill fluid lubricated bearing assembly forming a second bearing assembly spaced from said first bearing assembly, said second bearing assembly being located between said inner and outer cylindrical members; and orifices in the outer cylindrical member in the vicinity of said second bearing assembly for allowing drilling fluid from said drill bit to enter therein and exit therefrom to lubricate said second bearing assembly.

2. An improved bearing assembly as in claim 1 wherein the fluid flow restrictor creates a reduced pressurized cross-sectional area with respect to the second bearing assembly thereby causing a reduced drilling fluid thrust pressure area for transmitting pressure to said second bearing assembly.

3. The improved bearing assembly as in claim 1 further comprising:

a first threaded section on the outer upper end of the inner hollow cylindrical member; and a second threaded section on the inner upper end of the outer hollow cylindrical member such that said first and second threaded sections enable said bearing assembly to be coupled to said power section.

4. The improved bearing assembly as in claim 3 wherein said first and second threaded sections have tapered profiles.

5. The improved bearing assembly as in claim 4 further comprising:

a coupling adapter having a cylindrical hollow interior, a sealed upper end and an inverted cup-shaped lower end having an annular wall with tapered interior threads for attaching to said first threaded section on the outer upper end of said inner hollow cylindrical member;

substantially opposing slots in said coupling adapter for allowing turbulent drilling fluid from said power section to enter said hollow interior thereof and the hollow center of said inner cylindrical member for travel to said drill bit section;

each of said opposing slots having a first wall extending into said hollow interior at substantially a tangent to said hollow interior; and each of said opposing slots having a second wall extending into said hollow interior at an angle with respect to said first wall sufficient to impart a rotation to said drill bit fluid entering said opposed slots to transform a turbulent flow of drilling fluid to laminar flow as it moves through said hollow center of said inner cylindrical member to said drill bit section.

6. The improved bearing assembly as in claim 5 further comprising:

an erosion resistant coating surface formed on each wall of each opposing slot to reduce the rate of erosion of said opposing slot walls.

7. The improved bearing assembly as in claim 6 wherein the erosion resistant coating is tungsten carbide.

8. The improved bearing assembly as in claim 5 wherein said inner hollow cylindrical member further comprises:

a flat upper top;

a threaded annular external portion that is detachably engagable with the interior threads of said inverted cup-shaped lower end of said coupling adapter in a substantially fluid-tight relationship; and a substantially cylindrical peripheral portion below said threaded annular external portion.

9. The improved bearing assembly as in claim 8 further including:

a flat surface forming a base of the inside of said inverted cup-shaped lower end of said coupling adapter for engaging the corresponding flat upper top of said inner hollow cylindrical member to form a junction with a first substantially fluid-tight seal;

an annular cylindrical skirt forming part of and extending downwardly from said annular wall of said inverted cup to a point below the threaded external annular portion of the inner hollow cylindrical member to engage said cylindrical peripheral portion of said inner hollow cylindrical member to form a second substantially fluid-tight seal and support for oscillating loads;

an annular recess in said hollow center of said inner hollow cylindrical member and extending into said hollow interior of said coupling adapter;

an abrasion resistant annular hollow collar for mating insertion in said recess in said inner hollow cylindrical member and in said hollow interior of said coupling adapter and having an inside diameter aligned with and substantially equal to that of said hollow center of said inner hollow cylindrical member and the hollow interior of said coupling adapter and being positioned over said junction of the flat upper top of said inner hollow cylindrical member and the flat surface forming the base of the inside of said inverted cup-shaped lower end of each coupling adapter to protect the junction from erosion.

10. The improved bearing assembly as in claim 1 wherein the high pressure fluid flow restrictor forming said first bearing assembly comprises:

first and second spaced annular bearings in fluid-tight arrangement between said inner and outer concentric hollow cylinder members; and a fluid sealed in said space between said first and second annular bearings.

11. The improved bearing assembly as in claim 10 wherein the high pressure fluid flow restrictor can move longitudinally with respect to said inner and outer hollow cylinder members when under pressure to act as a hydrostatic pressure compensation system by balancing opposing pressures and substantially preventing a pressure differential across said high pressure fluid flow restrictor.

12. The improved bearing assembly as in claim 11 wherein each of said first and second annular bearings of said fluid flow restrictor includes:

a rotary seal that is used to assist in preventing the drilling fluid flow from said drill pipe from passing between said inner and outer hollow concentric cylindrical members;

a radial bearing in a bearing race to assist in controlling oscillating loads; and a plurality of static seals utilizing a high interference fit to prevent rotation of said bearing race and to create a sealed surface to assist in preventing the drilling fluid entering said space between said first and second annular bearings.

13. The improved bearing assembly as in claim 12 wherein:

the rotary seal for the first annular bearing is a low pressure seal; and the rotary seal for the second spaced annular bearing is a high pressure seal.

14. The improved bearing assembly as in claim 1 wherein said second bearing assembly includes both thrust bearings and radial bearings.

15. In a downhole motor for coupling to a drill pipe string and having a power section, a bearing section, and a drill bit section, and wherein the bearing section has an upper end and a lower end, an outer hollow cylindrical member, a rotatable concentric inner cylindrical member having a hollow center and being in radial spaced relationship with said outer hollow cylindrical member, and bearing means for supporting said inner and outer cylindrical members for relative rotation by said power section and for transmission of both thrust loads and radial loads therebetween, a coupling adapter for coupling said bearing section to said power section and comprising:

an elongated annular wall having a first portion with a first thickness forming a member with a hollow cylindrical core and having one end sealed to form a closed upper end and a second portion forming an inverted cup-shaped lower end, said second portion of said annular wall having a second thickness less than said first thickness of said first portion;

external threads around an external portion of said closed upper end for attaching to said power section;

tapered threads on at least a portion of the interior of said cup-shaped lower end for attaching to said bearing section;

said hollow core of said coupling adapter being in axial alignment with said hollow center of said inner cylindrical member;

substantially opposing slots in said first thickness of said elongated annular wall in fluid transfer relationship with said hollow core for allowing drilling fluid from said power section to enter said hollow core for travel to said drill bit section;

each of said opposing slots having a first wall extending into said hollow core at substantially a tangent to said hollow core; and each of said opposing slots have a second wall extending into said hollow core at an angle with respect to said first wall so as to impart a rotation to said drilling fluid entering said opposed slots to transform any turbulent flow of said drilling fluid into laminar flow as it moves through said hollow core of said inner cylindrical member to said drill bit section.

16. A coupling adapter section as in claim 15 wherein the angle at which the second wall extends into the hollow is greater than 45 degrees with respect to said first wall.

17. In a downhole motor for coupling to a drill pipe string and having a power section, a bearing section, and a drill bit section, with drilling fluid moving down said drill string from an uphole source to drive said power section, rotate said drilling bit and exit therefrom to return uphole, the bearing section having an upper end and a lower end, an outer hollow cylindrical member, a rotatable concentric inner hollow cylindrical member in radial spaced relationship with said outer hollow cylindrical member; and bearing means for supporting said inner and outer cylindrical members for relative rotation by said power section and for transmission of both thrust loads and radial loads therebetween, said bearing section including:

a first drill fluid lubricated bearing assembly being located between said inner and outer cylindrical members;

a second fluid sealed bearing assembly above said first drilling fluid lubricated bearing assembly and positioned between said inner and outer cylindrical members to prevent drilling fluid from said power section from directly reaching said first drilling fluid lubricated bearing assembly from within said inner and outer cylindrical member; and at least two orifices in the outer cylindrical member in the vicinity of said first bearing assembly for allowing drilling fluid exiting from said drill bit to enter therein and exit therefrom to lubricate said first bearing assembly.

18. A method of retrofitting the bearing section of an existing downhole motor driven by drilling fluid from an uphole source to rotate a drill bit, the drilling fluid exiting the drill bit and returning uphole, the bearing section having an upper end and a lower end, an outer hollow cylindrical member, a rotatable concentric inner cylindrical member with a hollow center and in radial spaced relationship with said outer hollow cylindrical member, an upper and a lower spaced drilling fluid lubricated bearing assembly located between said inner and outer hollow cylindrical members for supporting said inner and outer cylindrical members for relative rotation by said power section and for transmission of both thrust loads and radial loads therebetween, the retrofitting method comprising the steps of:

removing the upper drilling fluid lubricated bearing assembly from between said inner and hollow cylindrical members; inserting a sealed bearing assembly between said inner and outer hollow cylindrical members to replace said upper drilling fluid lubricated bearing assembly and to prevent drilling fluid from directly reaching said lower spaced bearing assembly from within said inner and outer hollow cylindrical members; and drilling at least two spaced orifices in said outer hollow cylindrical member in the vicinity of said lower spaced bearing assembly for allowing drilling fluid exiting from said drill bit to enter therein and exit therefrom to lubricate said lower spaced bearing assembly.

19. The method of claim 18 further including the steps of:

attaching a coupling adapter with a hollow interior to the upper end of said inner hollow cylindrical member such that the hollow interior of the coupling adapter is in alignment with the hollow center of the inner hollow cylindrical member; and providing orifices in said hollow coupling adapter communicating with the interior thereof to convert turbulent drilling fluid flow to laminar flow through said hollow center of said inner hollow cylindrical member.

20. The method of claim 19 further including the steps of:

forming said orifices as a pair of substantially opposing slots;

extending a first wall of each of said opposing slots into said hollow interior of said coupling adapter at substantially a tangent to said hollow interior; and extending a second wall of each of said opposing slots into said hollow interior at a angle greater than 45 degrees with respect to said first wall so as to impart a rotation to said drill bit fluid entering said opposed slots to transform any turbulent flow of drilling fluid to laminar flow as it moves through said hollow center of said inner cylindrical member to said drill bit section.

* * * * *